US010834970B2

(12) United States Patent
Verleur et al.

(10) Patent No.: US 10,834,970 B2
(45) Date of Patent: Nov. 17, 2020

(54) COMBINATION VAPORIZER

(71) Applicant: VMR Products LLC, Miami, FL (US)

(72) Inventors: Jan Andries Verleur, Miami Beach, FL (US); Dan Recio, Miami Beach, FL (US); Zhiyuan Liu, Miami, FL (US); Hans Verleur, El Dorado, CA (US)

(73) Assignee: VMR Products, LLC, San Francisco, CA (US)

( * ) Notice: Subject to any disclaimer, the term of this patent is extended or adjusted under 35 U.S.C. 154(b) by 72 days.

(21) Appl. No.: 15/829,493

(22) Filed: Dec. 1, 2017

(65) Prior Publication Data

US 2018/0153221 A1 Jun. 7, 2018

Related U.S. Application Data

(60) Provisional application No. 62/429,348, filed on Dec. 2, 2016, provisional application No. 62/465,419, filed on Mar. 1, 2017.

(51) Int. Cl.

| | |
|---|---|
| ***A24F 47/00*** | (2020.01) |
| ***A24B 15/167*** | (2020.01) |
| ***A61M 15/06*** | (2006.01) |

(52) U.S. Cl.

CPC ..... *A24F 47/008* (2013.01); *A24B 15/167* (2016.11)

(58) Field of Classification Search

None

See application file for complete search history.

(56) References Cited

U.S. PATENT DOCUMENTS

| | | | | |
|---|---|---|---|---|
| 2,104,266 | A * | 1/1938 | McCormick | A24F 47/008 131/198.1 |
| 2,830,597 | A * | 4/1958 | Kummli | A24F 47/002 131/273 |
| 3,402,723 | A * | 9/1968 | Hu | A24F 3/00 131/185 |
| 4,193,411 | A * | 3/1980 | Faris | A24F 1/00 131/224 |
| 4,303,083 | A * | 12/1981 | Burruss, Jr. | A61M 15/06 131/194 |
| 4,947,874 | A * | 8/1990 | Brooks | A24F 47/008 128/202.21 |
| 4,947,875 | A * | 8/1990 | Brooks | A24F 47/006 128/202.21 |
| 8,499,766 | B1 * | 8/2013 | Newton | A24F 47/002 131/273 |
| 8,550,069 | B2 | 10/2013 | Alelov | |
| 8,897,628 | B2 | 11/2014 | Conley et al. | |

(Continued)

FOREIGN PATENT DOCUMENTS

| | | |
|---|---|---|
| CA | 2882773 C | 6/2018 |
| CN | 203762289 U | 8/2014 |

(Continued)

*Primary Examiner* — Thor S Campbell

(74) *Attorney, Agent, or Firm* — Mintz Levin Cohn Ferris Glovsky and Popeo, P.C.

(57) ABSTRACT

A combination vaporizer is disclosed. The vaporizer includes a first body having a cavity for receiving a cartridge containing a first product, and a second body containing a second product. An atomizer in the first cartridge vaporizes the first product and an atomizer in the second body vaporizes the second product. The two vapors are combined in a controlled amount and exit through an outlet of the first body.

20 Claims, 9 Drawing Sheets

(56) References Cited

U.S. PATENT DOCUMENTS

D757,995 S * 5/2016 Liu ..... D27/101
9,386,805 B2 7/2016 Liu
9,440,035 B2 9/2016 Chung
9,603,386 B2 * 3/2017 Xiang ..... A24F 47/008
9,675,114 B2 * 6/2017 Timmermans ..... A24F 47/008
9,687,029 B2 6/2017 Liu
9,772,216 B2 9/2017 Poole et al.
9,801,416 B2 * 10/2017 Robinson ..... A24F 47/008
9,802,011 B2 10/2017 Davidson et al.
9,808,032 B2 * 11/2017 Yamada ..... A24F 47/008
10,004,259 B2 * 6/2018 Sebastian ..... A24F 47/008
1,003,932 A1 8/2018 Verleur et al.
1,007,613 A1 9/2018 Monsees et al.
1,008,548 A1 10/2018 Verleur et al.
10,111,464 B1 * 10/2018 Balder ..... A24F 47/004
1,011,746 A1 11/2018 Monsees et al.
10,244,793 B2 * 4/2019 Monsees ..... A24F 47/008
1,027,842 A1 5/2019 Garthaffner et al.
1,032,747 A1 6/2019 Li et al.
10,357,060 B2 * 7/2019 Rostami ..... H04B 7/26
10,368,580 B2 * 8/2019 Rostami ..... A24F 47/008
10,369,302 B2 * 8/2019 Suzuki ..... A61M 11/042
1,040,557 A1 9/2019 Collett et al.
2005/0034723 A1 * 2/2005 Bennett ..... A61K 9/007 128/203.12
2007/0283972 A1 * 12/2007 Monsees ..... A61M 15/0028 131/273
2008/0038363 A1 * 2/2008 Zaffaroni ..... A61M 11/041 424/502
2009/0095287 A1 * 4/2009 Emarlou ..... A61M 11/041 128/200.14
2010/0181387 A1 * 7/2010 Zaffaroni ..... A61M 15/06 239/13
2010/0313901 A1 * 12/2010 Fernando ..... H02J 7/0044 131/330
2011/0036346 A1 * 2/2011 Cohen ..... A61M 11/042 128/200.14
2011/0036363 A1 * 2/2011 Urtsev ..... A24F 47/002 131/273
2012/0048266 A1 * 3/2012 Alelov ..... A61M 15/0003 128/202.21
2012/0090630 A1 * 4/2012 Hon ..... H02J 7/0045 131/273
2013/0019887 A1 * 1/2013 Liu ..... A24F 47/008 131/329
2013/0042865 A1 * 2/2013 Monsees ..... A61M 15/06 128/203.27
2013/0104916 A1 * 5/2013 Bellinger ..... A61M 11/041 131/328
2013/0284192 A1 * 10/2013 Peleg ..... A24F 47/002 131/329
2013/0319440 A1 * 12/2013 Capuano ..... A61M 15/06 131/329
2013/0340775 A1 * 12/2013 Juster ..... H04L 67/42 131/273
2014/0053856 A1 * 2/2014 Liu ..... A24F 47/008 131/329
2014/0060527 A1 * 3/2014 Liu ..... A61M 15/06 128/202.21
2014/0060554 A1 * 3/2014 Collett ..... H05B 3/265 131/328
2014/0060556 A1 * 3/2014 Liu ..... A24F 47/008 131/329
2014/0081234 A1 * 3/2014 Eggert ..... A61M 5/14566 604/500
2014/0107815 A1 * 4/2014 LaMothe ..... A24F 15/18 700/90
2014/0123989 A1 * 5/2014 LaMothe ..... A24F 47/008 131/328
2014/0123990 A1 * 5/2014 Timmermans ..... A24F 47/008 131/328
2014/0166029 A1 * 6/2014 Weigensberg ..... A24F 47/008 131/329
2014/0174459 A1 * 6/2014 Burstyn ..... A24F 47/008 131/273
2014/0224267 A1 * 8/2014 Levitz ..... A24F 47/008 131/329
2014/0246035 A1 * 9/2014 Minskoff ..... A24F 47/008 131/329
2014/0251324 A1 * 9/2014 Xiang ..... A24F 47/008 128/202.21
2014/0261486 A1 * 9/2014 Potter ..... A24F 47/008 131/328
2014/0261488 A1 * 9/2014 Tucker ..... A24F 47/008 131/328
2014/0305820 A1 * 10/2014 Xiang ..... A24F 15/18 206/236
2014/0334804 A1 * 11/2014 Choi ..... A61M 15/06 392/404
2014/0338684 A1 11/2014 Liu
2014/0345635 A1 11/2014 Rabinowitz et al.
2014/0360512 A1 * 12/2014 Xiang ..... H02J 7/0077 131/328
2014/0366898 A1 * 12/2014 Monsees ..... A24F 47/008 131/329
2015/0027454 A1 * 1/2015 Li ..... A24F 47/008 131/328
2015/0027469 A1 * 1/2015 Tucker ..... A24D 3/10 131/329
2015/0047662 A1 * 2/2015 Hopps ..... A24F 47/008 131/329
2015/0053217 A1 * 2/2015 Steingraber ..... A24F 47/008 131/329
2015/0059787 A1 3/2015 Qiu
2015/0075546 A1 * 3/2015 Kueny, Sr. ..... A24F 47/008 131/329
2015/0122252 A1 * 5/2015 Frija ..... A24F 47/008 128/202.21
2015/0173124 A1 * 6/2015 Qiu ..... A24F 47/008 131/328
2015/0196055 A1 7/2015 Liu
2015/0196059 A1 7/2015 Liu
2015/0224268 A1 * 8/2015 Henry ..... A24F 47/008 128/202.21
2015/0237917 A1 * 8/2015 Lord ..... A24F 47/008 131/328
2015/0245661 A1 * 9/2015 Milin ..... A24F 47/008 131/329
2015/0257445 A1 * 9/2015 Henry, Jr. ..... A24F 47/008 131/328
2015/0257447 A1 * 9/2015 Sullivan ..... A24F 47/008 131/329
2015/0257448 A1 * 9/2015 Lord ..... A24F 47/008 700/90
2015/0258289 A1 * 9/2015 Henry, Jr. ..... A61M 15/06 128/202.21
2015/0288468 A1 * 10/2015 Xiang ..... H04W 84/18 455/500
2015/0305409 A1 10/2015 Verleur et al.
2015/0313287 A1 11/2015 Verleur et al.
2015/0320116 A1 * 11/2015 Bleloch ..... A61M 15/06 219/628
2015/0357839 A1 * 12/2015 Cai ..... A24F 47/008 131/329
2015/0359263 A1 * 12/2015 Bellinger ..... H05B 1/0244 392/394
2016/0007651 A1 * 1/2016 Ampolini ..... A24F 47/008 131/328
2016/0021930 A1 * 1/2016 Minskoff ..... A61M 15/06 131/329
2016/0106156 A1 * 4/2016 Qiu ..... A24F 47/008 392/404
2016/0120226 A1 5/2016 Rado
2016/0135506 A1 * 5/2016 Sanchez ..... A24F 47/008 131/329
2016/0150828 A1 * 6/2016 Goldstein ..... A24F 47/008 392/387
2016/0219938 A1 * 8/2016 Mamoun ..... G05B 15/02
2016/0249684 A1 9/2016 Liu

(56) References Cited

U.S. PATENT DOCUMENTS

2016/0262456 A1 9/2016 Borkovec et al.
2016/0278436 A1 9/2016 Verleur et al.
2016/0285983 A1* 9/2016 Liu ..... A24F 47/002
2016/0331024 A1* 11/2016 Cameron ..... A24F 47/002
2016/0331026 A1* 11/2016 Cameron ..... A24F 47/002
2016/0331027 A1* 11/2016 Cameron ..... A24F 47/002
2016/0331035 A1* 11/2016 Cameron ..... F01K 5/00
2016/0331859 A1* 11/2016 Cameron ..... A61L 9/02
2016/0337362 A1* 11/2016 Cameron ..... H04L 63/10
2016/0338407 A1* 11/2016 Kerdemelidis ..... A24F 47/008
2016/0338408 A1 11/2016 Guenther, Jr. et al.
2016/0345628 A1* 12/2016 Sabet ..... A24F 15/18
2016/0360786 A1* 12/2016 Bellinger ..... H05B 1/0227
2016/0360790 A1 12/2016 Calfee et al.
2016/0363917 A1* 12/2016 Blackley ..... G05B 19/042
2016/0366939 A1 12/2016 Alarcon et al.
2016/0374401 A1* 12/2016 Liu ..... A24F 47/008 131/328
2017/0020192 A1* 1/2017 Fregonese ..... H05B 3/0014
2017/0042230 A1* 2/2017 Cameron ..... A24F 47/008
2017/0042231 A1* 2/2017 Cameron ..... A24F 47/008
2017/0045994 A1* 2/2017 Murison ..... A24F 15/18
2017/0046357 A1* 2/2017 Cameron ..... A24F 47/008
2017/0046738 A1* 2/2017 Cameron ..... G06Q 30/0255
2017/0049155 A1 2/2017 Liu
2017/0055588 A1* 3/2017 Cameron ..... H05B 3/44
2017/0064999 A1* 3/2017 Perez ..... A24F 47/008
2017/0071256 A1 3/2017 Verleur et al.
2017/0079327 A1* 3/2017 Wu ..... A24F 47/008
2017/0079329 A1* 3/2017 Zitzke ..... A24F 47/008
2017/0086496 A1* 3/2017 Cameron ..... B25F 1/04
2017/0086497 A1* 3/2017 Cameron ..... A24F 3/00
2017/0086503 A1* 3/2017 Cameron ..... A24F 47/008
2017/0086504 A1* 3/2017 Cameron ..... A24F 47/008
2017/0086505 A1* 3/2017 Cameron ..... A24F 47/008
2017/0086507 A1* 3/2017 Rado ..... A24F 47/008
2017/0091490 A1* 3/2017 Cameron ..... G06F 21/84
2017/0092106 A1* 3/2017 Cameron ..... G08B 21/24
2017/0093960 A1* 3/2017 Cameron ..... H04L 67/10
2017/0093981 A1* 3/2017 Cameron ..... H04L 67/12
2017/0119058 A1* 5/2017 Cameron ..... A24F 47/008
2017/0127727 A1* 5/2017 Davidson ..... A61K 36/81
2017/0135400 A1* 5/2017 Liu ..... A24F 47/008
2017/0135407 A1* 5/2017 Cameron ..... A24F 47/008
2017/0135408 A1* 5/2017 Cameron ..... A24F 47/008
2017/0135409 A1* 5/2017 Cameron ..... A24F 47/008
2017/0135410 A1* 5/2017 Cameron ..... A24F 47/008
2017/0135411 A1* 5/2017 Cameron ..... A24F 47/008
2017/0135412 A1* 5/2017 Cameron ..... A24F 47/008
2017/0136193 A1* 5/2017 Cameron ..... A61M 11/042
2017/0136194 A1* 5/2017 Cameron ..... A61M 11/042
2017/0136301 A1* 5/2017 Cameron ..... G16H 40/67
2017/0143917 A1* 5/2017 Cohen ..... A61M 11/042
2017/0150755 A1* 6/2017 Batista ..... A24F 47/008
2017/0150756 A1* 6/2017 Rexroad ..... A24F 47/008
2017/0157341 A1* 6/2017 Pandya ..... A61M 11/007
2017/0172204 A1 6/2017 Kane et al.
2017/0181467 A1* 6/2017 Cameron ..... A63F 13/90
2017/0181474 A1* 6/2017 Cameron ..... A24F 47/008
2017/0181475 A1* 6/2017 Cameron ..... A24F 47/008
2017/0185364 A1* 6/2017 Cameron ..... G06F 3/1446
2017/0196270 A1* 7/2017 Vick ..... A24F 47/008
2017/0208867 A1* 7/2017 Li ..... G08C 17/02
2017/0215480 A1* 8/2017 Qiu ..... A24F 47/008
2017/0224020 A1* 8/2017 Fernando ..... B65D 43/16
2017/0231280 A1* 8/2017 Anton ..... A24F 47/008 392/404
2017/0238596 A1 8/2017 Matsumoto et al.
2017/0238605 A1 8/2017 Matsumoto et al.
2017/0238606 A1 8/2017 Matsumoto et al.
2017/0238608 A1 8/2017 Matsumoto et al.
2017/0245550 A1* 8/2017 Freelander ..... A61M 15/06
2017/0245554 A1* 8/2017 Perez ..... A24F 47/008
2017/0251719 A1* 9/2017 Cyphert ..... A24F 1/00
2017/0251726 A1 9/2017 Nielsen
2017/0251727 A1 9/2017 Nielsen
2017/0258136 A1* 9/2017 Hawes ..... H04W 76/10
2017/0258138 A1 9/2017 Rostami et al.
2017/0258139 A1 9/2017 Rostami et al.
2017/0258140 A1 9/2017 Rostami et al.
2017/0258142 A1* 9/2017 Hatton ..... A24F 47/008
2017/0259170 A1* 9/2017 Bowen ..... A24F 47/008
2017/0273357 A1* 9/2017 Barbuck ..... H05B 3/04
2017/0280779 A1* 10/2017 Qiu ..... G05D 23/2401
2017/0290998 A1* 10/2017 Poston ..... A24F 47/008
2017/0295844 A1* 10/2017 Thevenaz ..... A24F 47/008
2017/0303590 A1* 10/2017 Cameron ..... G01P 5/02
2017/0303593 A1* 10/2017 Cameron ..... H05B 1/0227
2017/0303594 A1* 10/2017 Cameron ..... A24B 15/167
2017/0309091 A1* 10/2017 Cameron ..... G07C 5/0808
2017/0332702 A1* 11/2017 Cameron ..... A61K 9/0073
2017/0354180 A1* 12/2017 Fornarelli ..... A24F 47/008
2018/0070639 A1* 3/2018 Chen ..... A24F 47/008
2018/0070642 A1 3/2018 Monsees et al.
2018/0098569 A1* 4/2018 Martin ..... A24F 47/002
2018/0184712 A1* 7/2018 Fraser ..... A24F 47/008
2018/0192700 A1* 7/2018 Fraser ..... A24F 47/008
2018/0368481 A1 12/2018 Verleur et al.
2019/0069605 A1 3/2019 Verleur et al.
2019/0082740 A1 3/2019 Verleur et al.
2019/0082741 A1 3/2019 Verleur et al.
2019/0124979 A1* 5/2019 Sebastian ..... H05B 6/108
2019/0200677 A1* 7/2019 Chong ..... A24D 1/002
2019/0230987 A1* 8/2019 Wu ..... A24F 47/008

FOREIGN PATENT DOCUMENTS

DE 202014011273 U1 12/2018
DE 202014011284 U1 1/2019
DE 202014011289 U1 1/2019
EP 3073846 A2 10/2016
EP 3200632 A1 8/2017
KR 101363964 B1 2/2014
KR 20170132823 A 12/2017
WO WO-2012174677 A1 12/2012
WO WO-2014110750 A1 7/2014
WO WO-2014205780 A1 12/2014
WO WO-2015073564 A1 5/2015
WO WO-2015128499 A1 9/2015
WO WO-2015165081 A1 11/2015
WO WO-2015165146 A1 11/2015
WO WO-2015196463 A1 12/2015
WO WO-2016000233 A1 1/2016
WO WO-2016050246 A1 4/2016
WO WO-2016090426 A1 6/2016
WO WO-2016115701 A1 7/2016
WO WO-2016119119 A1 8/2016
WO WO-2016123763 A1 8/2016
WO WO-2016138608 A1 9/2016
WO WO-2016141593 A1 9/2016
WO WO-2016155003 A1 10/2016
WO WO-2016174179 A1 11/2016
WO WO-2017005835 A1 1/2017
WO WO-2017045132 A1 3/2017
WO WO-2017060279 A1 4/2017
WO WO-2017063535 A1 4/2017
WO WO-2017141358 A1 8/2017
WO WO-2017166334 A1 10/2017
WO WO-2017173669 A1 10/2017
WO WO-2017174754 A1 10/2017
WO WO-2019005889 A1 1/2019

* cited by examiner

COMBINATION VAPORIZER

CROSS REFERENCE TO RELATED APPLICATIONS

This application claims the benefit of U.S. Provisional Application Ser. No. 62/429,348, filed Dec. 2, 2016 and U.S. Provisional Application Ser. No. 62/465,419, filed Mar. 1, 2017, the disclosures of each of which are hereby incorporated herein by reference in their entireties.

BACKGROUND

1. Technical Field Text

This disclosure relates generally to vaporizers, which may also be referred to as electronic cigarettes.

2. Background Information

Vaporizers have recently emerged as a new product for providing nicotine and other products through a smokeless inhalation process. There are many embodiments of vaporizers including the electronic cigarette. In general, implementations consist of a power supply (typically a battery) and an atomizing device. In reusable electronic cigarettes, the two items are separated into a battery and a cartomizer, to allow the disposal and replacement of the nicotine containing fluid cartomizer while preserving for additional use the more costly battery and associated circuitry (microcontroller, switch, indicating light emitting diode (LED), etc.). In disposable electronic cigarettes the two functions are integrated into one unit that is disposed of after exhaustion of either the battery energy or the vaporizable fluid ("E-liquid"), typically nicotine-containing, that is associated with the cartomizer.

The E-liquid that is used to produce vapor in electronic cigarettes is typically a flavor concentrate, optionally with a variable percentage of a liquid nicotine concentrate, dissolved in a solution of one or more of propylene glycol (PG) and/or vegetable glycerin (VG) and/or polyethylene glycol 400 (PEG400). This liquid is often sold in a bottle or in disposable cartridges or cartomizers. Many different flavors of such E-liquids are sold, including flavors that resemble the taste of regular tobacco, menthol, vanilla, coffee, cola and various fruits. E-liquids containing a wide range of nicotine concentrations, as well as nicotine-free liquids are available in the marketplace.

In addition to E-liquid, other products may be used to produce vapor such as waxes and solids such as loose leafs. Generally, each type of product requires a specific type of atomizer. A loose leaf product may be vaporized by a hot stream of gas, whereas waxes and E-liquids may be vaporized upon contact with a heated element.

BRIEF SUMMARY

A vaporizer for vaporizing combinations of product is disclosed. The vaporizer includes a first a first body, a cartridge, a second body, a controller, and a fluid path. The first body has an air inlet and a cavity for receiving the cartridge. The cartridge is disposed in the cavity and contains a first product. A second body contains a second product and has a recess complementary to the shape of the first body. The controller is in communication with the first cartridge and the second body and is configured to control the amount of vapor produced by each cartridge. The fluid path passes from the second body through the inlet to the first body to provide vapor from the second body to the first cartridge.

DETAILED DESCRIPTION

The following detailed description and the appended drawings describe and illustrate some embodiments of the disclosure for the purpose of enabling one of ordinary skill in the relevant art to make and use these embodiments. As such, the detailed description and illustration of these embodiments are purely illustrative in nature and are in no way intended to limit the scope of the disclosure in any manner. It should also be understood that the drawings are not necessarily to scale and in certain instances details may have been omitted, which are not necessary for an understanding of the embodiments, such as details of fabrication and assembly. In the accompanying drawings, like numerals represent like components.

Figure 1:
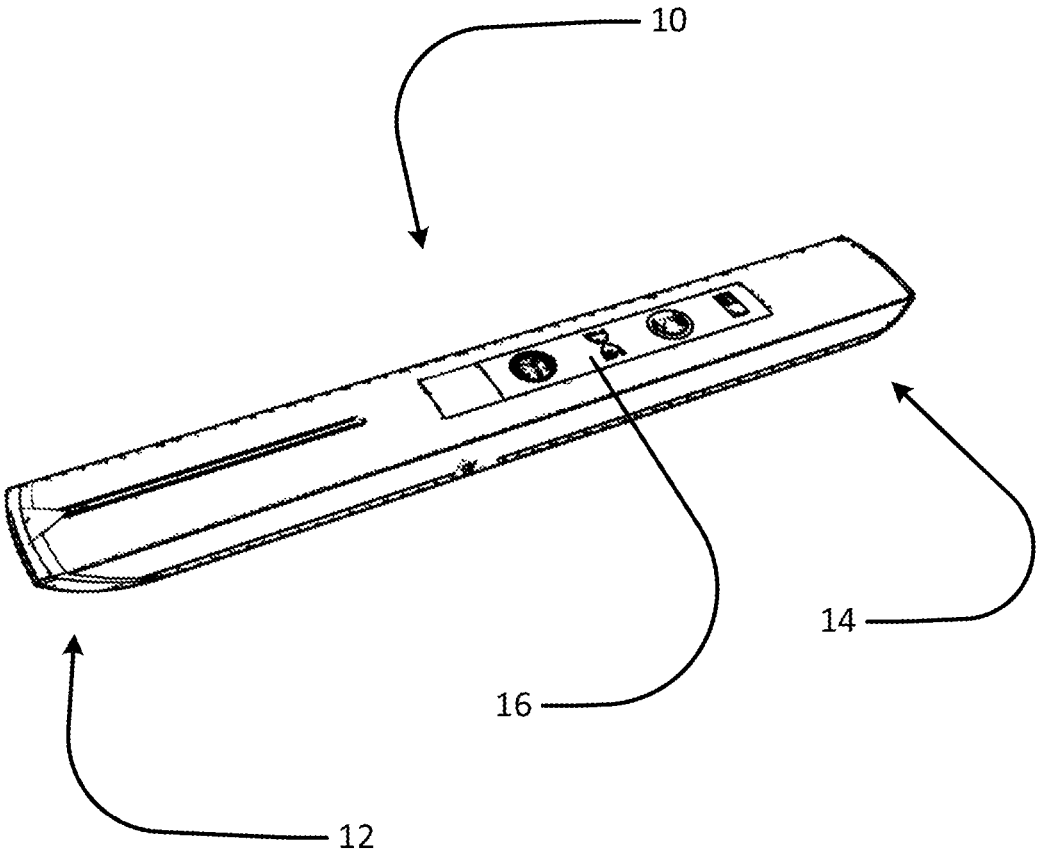
FIG. 1 illustrates a perspective view of a vaporizer.

FIG. 1 illustrates a perspective view of a vaporizer 10. Vaporizer 10 receives product, such as E-liquid, wax, or solids, in cartridges that are loaded into vaporizer 10. Because each type of product may require a different type of atomizer, each cartridge may have an integral atomizer. One of ordinary skill in the art will recognize that various types of atomizers currently exist and may be used to vaporize product in a cartridge. Vaporizer 10 supplies power to the cartridge, which activates the atomizer to produce vapor from the product. The vapor is in turn mixed with incoming air for delivery to a user. Vaporizer 10 typically contains a power source such as a battery, and a control panel 16 providing an interface for a user to operate vaporizer 10. A lower end 14 of vaporizer 10 has an inlet 15 (FIG. 2) for receiving incoming air and an upper end 12 of vaporizer 10 may have an outlet for delivering vapor. Inlet 15 may be in addition to a cartridge inlet for receiving air, or it may be the only inlet. Inlet 15 provides a fluid path through the vaporizer to the cartridge. The vaporizer 10 may also have a power port for charging the battery, or an inductive element for wirelessly charging the battery.

Figure 2:
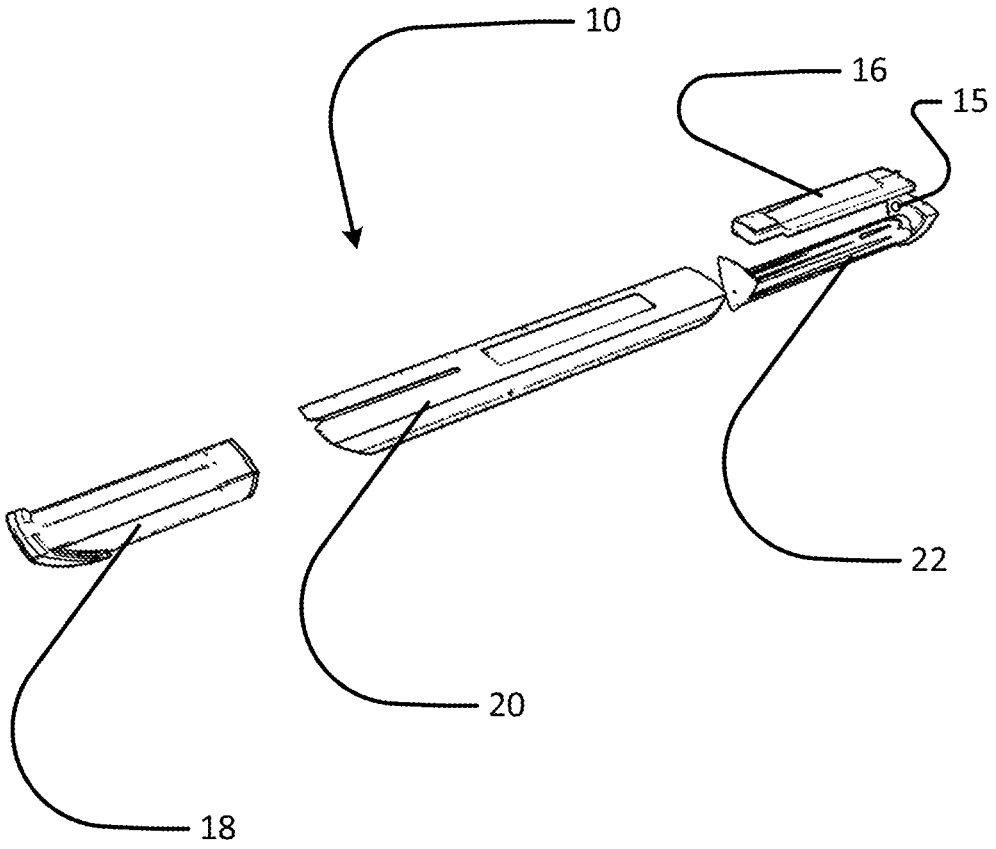
FIG. 2 illustrates an exploded view of the vaporizer of FIG. 1.

FIG. 2 illustrates an exploded view of first vaporizer element 10. The vaporizer 10 includes cartridge 18, body 20, control panel 16, and battery 22. Battery 22 and control panel 16 may be permanently secured within body 20, while cartridge 18 is removable from body 20. Control panel 16 is electrically coupled to battery 22 and cartridge 18 when assembled.

Figure 3:
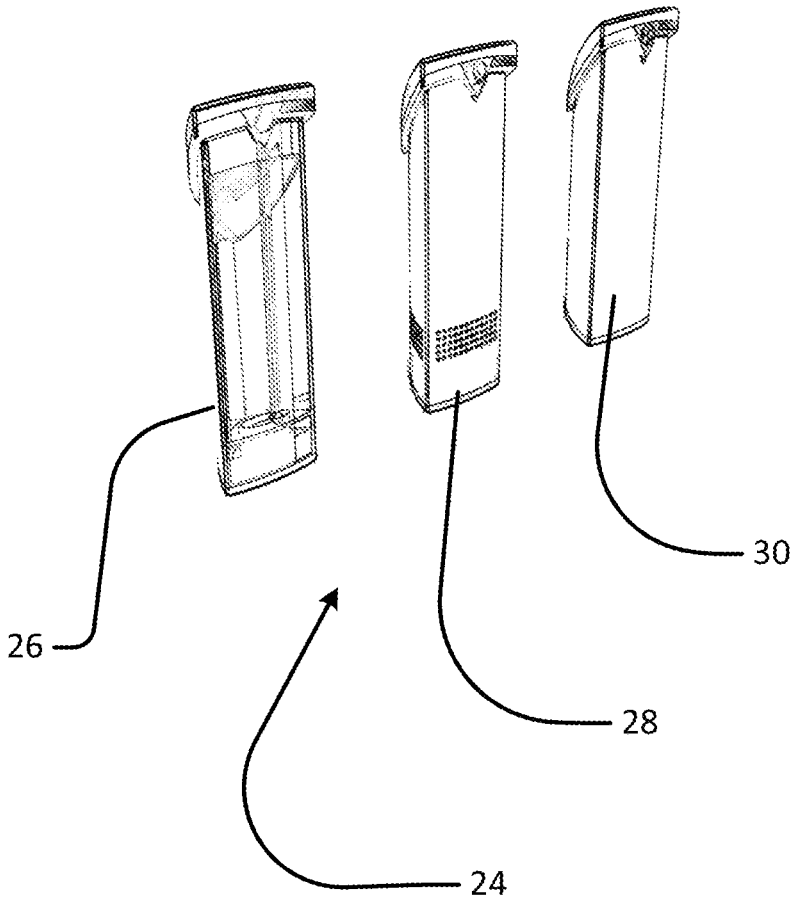
FIG. 3 illustrates cartridges for use in the vaporizer of FIG. 1.

FIG. 3 illustrates cartridges 24 for use in first vaporizer element 10. Cartridges 24 include loose leaf cartridge 26, wax cartridge 28, and E-liquid cartridge 30. Cartridges 24 may be releasably secured within the upper end 12 of the vaporizer 10 and exchanged with one another depending on user preference. Each cartridge 24 contains product in a vaporizable product container 11 and an atomizer 13 specific to that product type. Cartridge 24 may be refillable by a user. Control panel 16 may recognize the type of cartridge 24 in use by the vaporizer 10 and adjust vaporizing parameters such as voltage delivered to the cartridge and timing as necessary for the product type. The control panel 16 may allow further customization by the user or a manual setup for product not recognized by the control panel 16.

Figure 4:
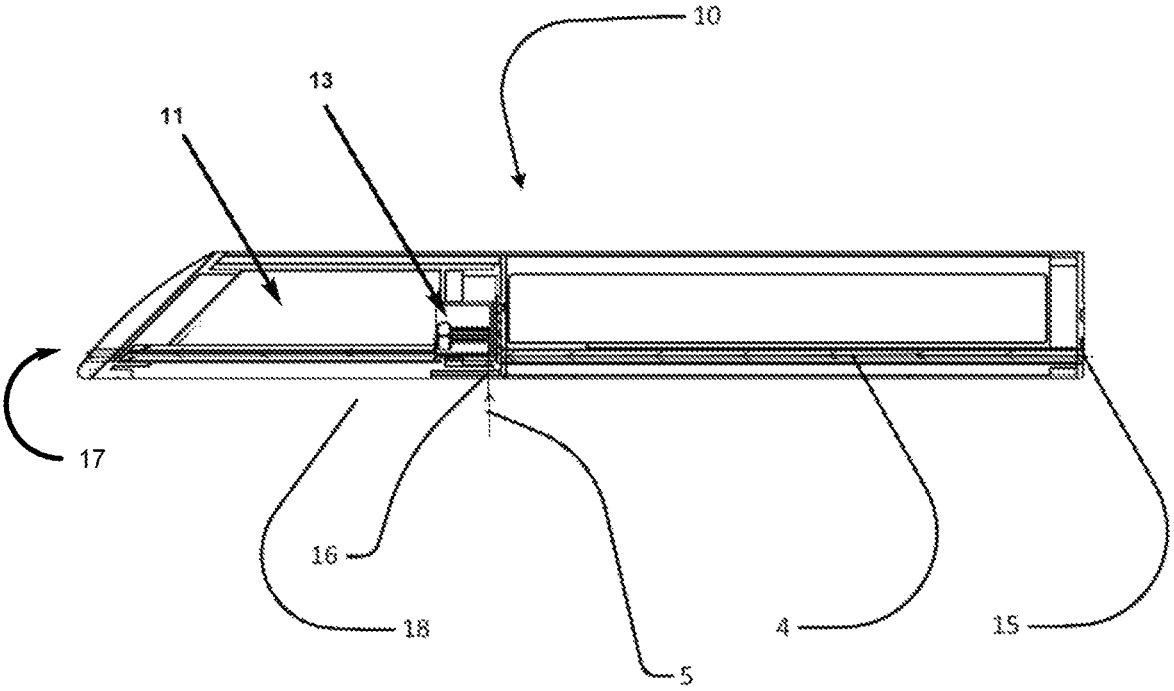
FIG. 4 illustrates a schematic view of the airflow of the vaporizer of FIG. 1.

FIG. 4 illustrates a schematic view of the vaporizer 10 of FIG. 1. Arrow 4 illustrates an air path from the lower end of the vaporizer 10 from inlet 15. Arrow 5 illustrates an alternative air path using inlet 16. Embodiments may have a selectable air path, such that air may flow along arrow 4 or arrow 5. Vaporizable liquid, after vaporization in the atomizer 13, is exhausted to the external environment via vapor outlet 17.

Figure 5:
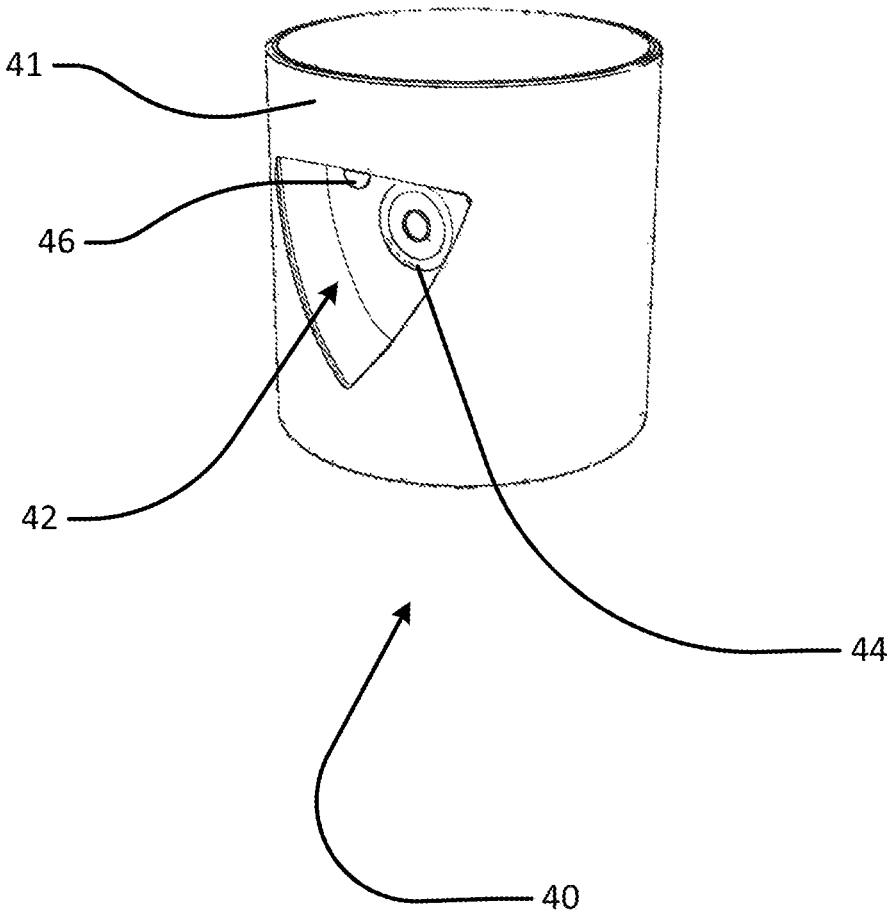
FIG. 5 illustrates an embodiment of an add-on tank.

FIG. 5 illustrates an add-on tank 40 (second vaporizer element) which enhances vaporizer 10. Add-on tank 40 is configured to couple to vaporizer 10 and provide enhancements such as extra battery life, an additional heating unit, and/or additional product. In the embodiment of FIG. 4, add-on tank 40 has a body 41 with a recess 42 that complements the shape of lower end 14 of vaporizer 10. Lower end 14 of vaporizer 10 may be inserted into recess 42 to couple vaporizer 10 and add-on tank 40 together. While add-on tank 40 is shown with a cylindrical body, other shapes are possible such as a box or sphere.

Figure 6:
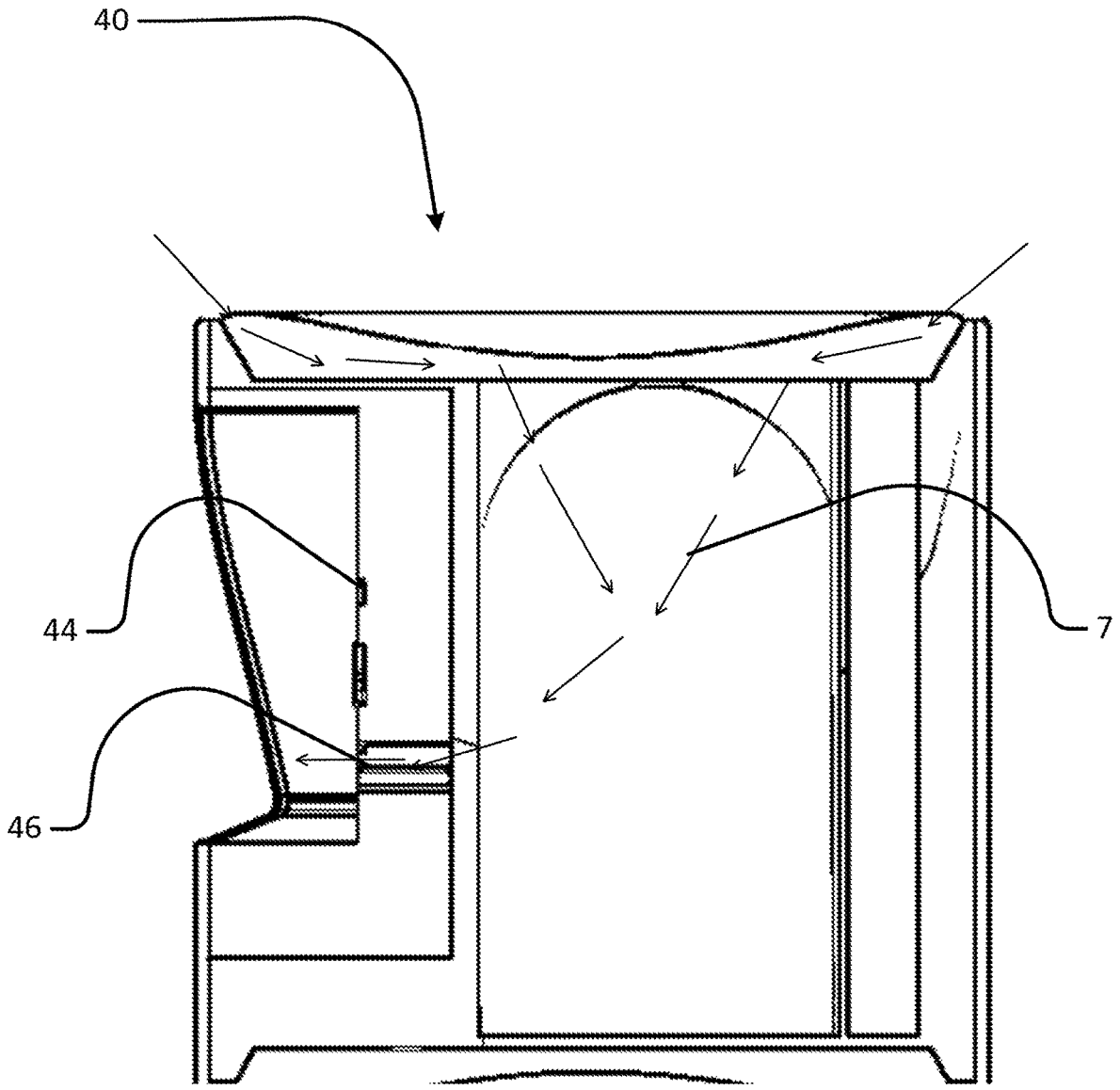
FIG. 6 illustrates a schematic view of the airflow of the add-on tank of FIG. 5.

FIG. 6 illustrates a schematic view of add-on tank 40 of FIG. 5. Add-on tank 40 has a flow path depicted by arrows 7. Add-on tank 40 includes an interface 44 for communicating with vaporizer 10. Interface 44 may interface with vaporizer 10 through a charging port, or in outer embodiment may have electrical contacts that contact corresponding contacts of the vaporizer 10. Control panel 16 may identify the add-on tank 40 and modify the interface accordingly. Add-on tank 40 further includes a port 46 that aligns with air inlet 15 of vaporizer 10 when connected. Port 46 allows vaporizer 10 to continue to receive air when add-on tank 40 is secured to vaporizer 10.

Figure 7:
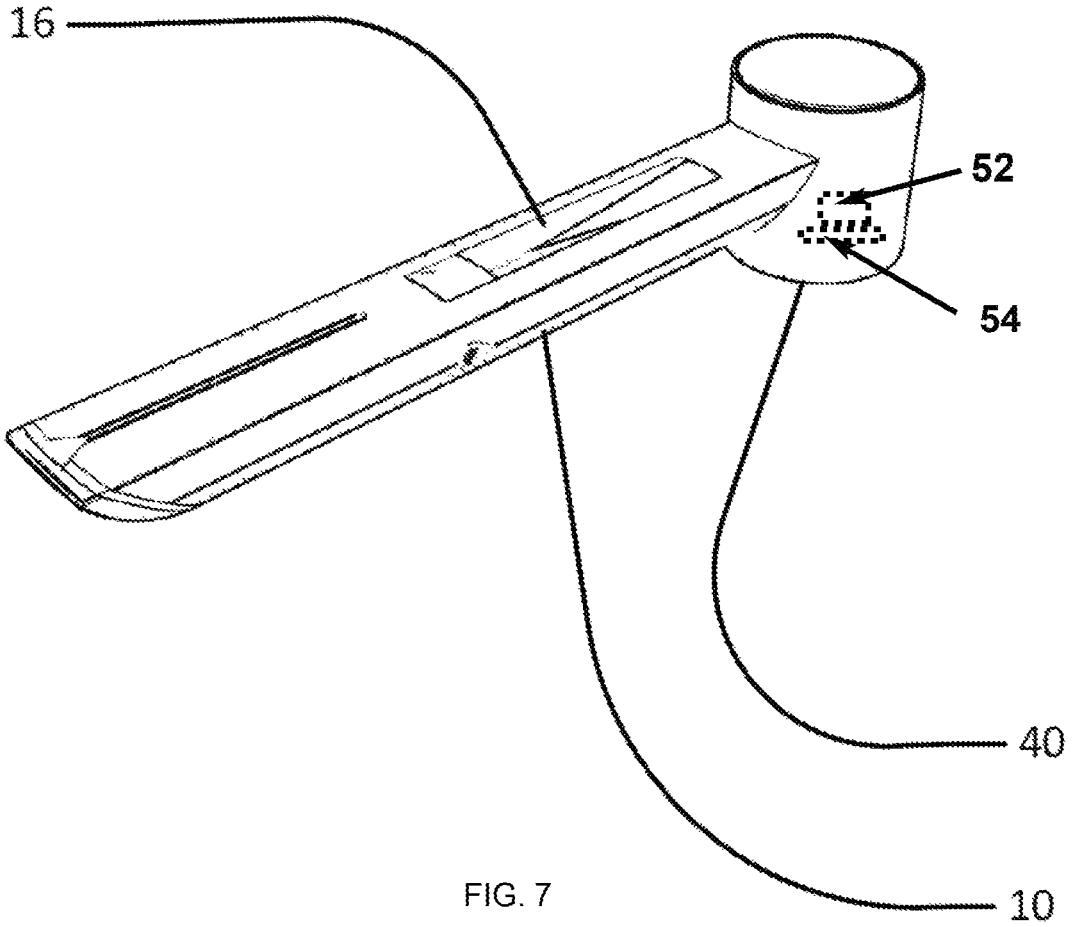
FIG. 7 illustrates an embodiment of a vaporizer combined with an add-on tank.

FIG. 7 illustrates vaporizer 10 being secured to add-on tank 40. In some embodiments, vaporizer 10 and add-on tank 40 may be secured to one another using magnets contained in lower end 14 of vaporizer 10 and in add-on tank 40. FIG. 7 also illustrates an atomizer 52 and a heating element 54, each hidden from view. Intake air passes through port 46 or vapor outlet 56.

Figure 8:
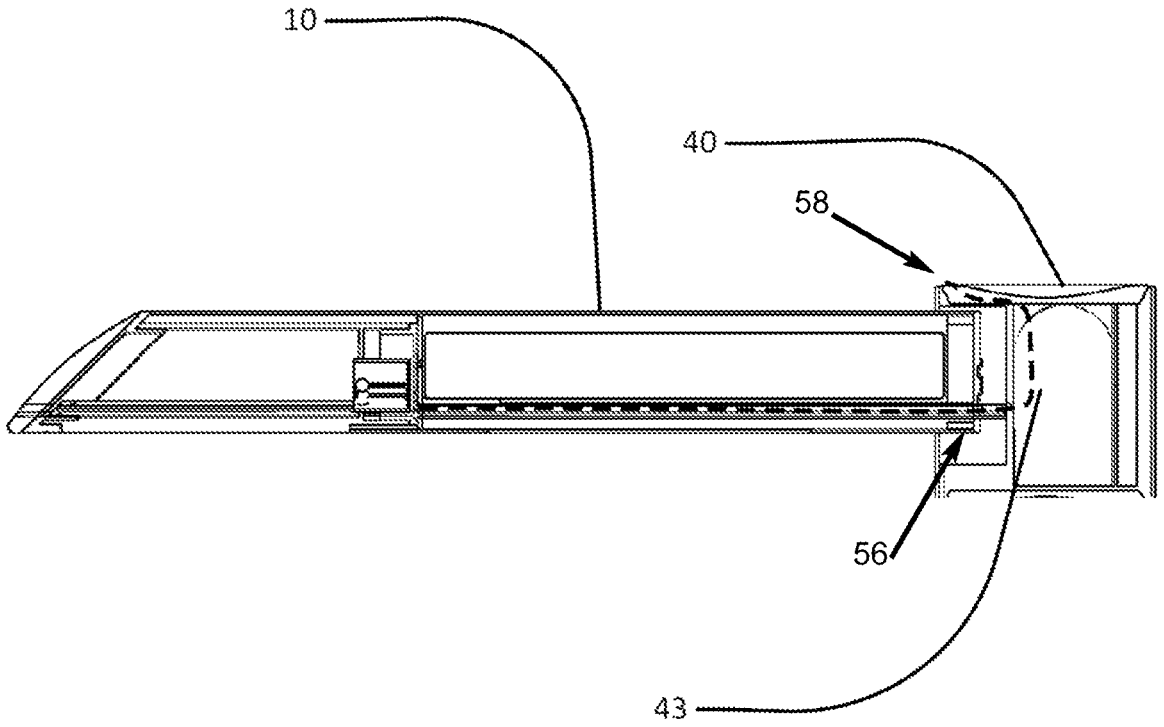
FIG. 8 illustrates a schematic view of the airflow of the embodiment of FIG. 7.

FIG. 8 illustrates a schematic of vaporizer 10 being connected to add-on tank 40. Flow path 43 passes through add-on tank 40 and into vaporizer 10. In embodiments in which add-on tank 40 is a battery, flow path 43 may be a simple channel passing through the add-on tank 40 for providing air to inlet 15 of vaporizer 10. In other embodiments, add-on tank 40 may contain an additional heater and additional product, including a product container, for vaporizing. In such embodiments, vapor from add-on tank 40 and air is supplied to vaporizer 10 through port 46.

The additional atomizer in add-on tank 40 allows for the vaporizer to deliver combinations of vapor from separate products. Control panel 16 may control the relative amount of vaporization between the two atomizers, which may be adjustable based on user preference. The add-on tank 40 allows for combinations of product such as E-liquid and loose leaf, E-liquid and wax, E-liquid (flavor 1) and E-liquid (flavor 2), and Loose Leaf and Wax. In addition to these combinations, the user may adjust the relative quantities of the product to obtain a diversity of product.

Figure 9:
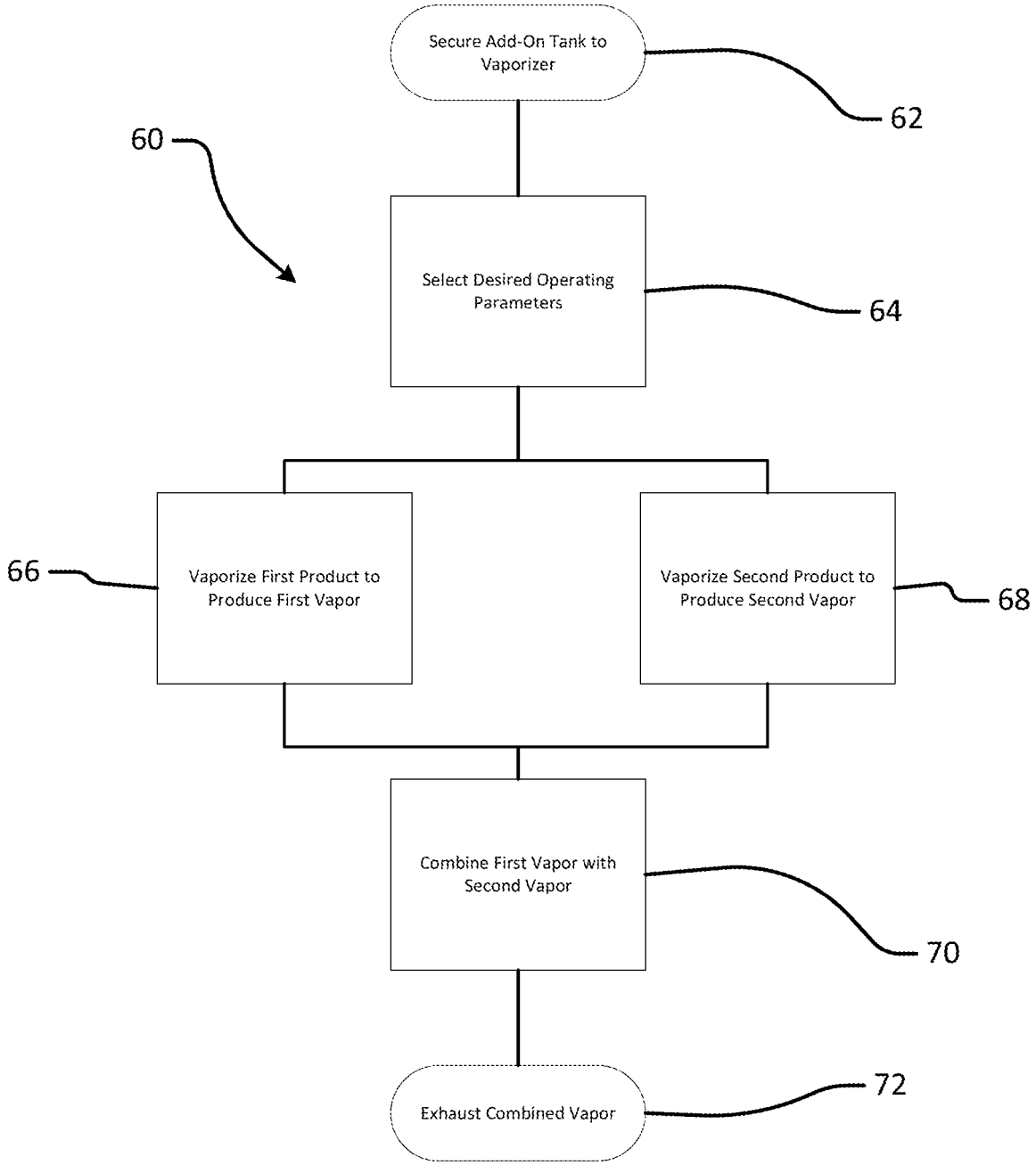
FIG. 9 illustrates an embodiment of a method for producing custom vapor.

FIG. 9 illustrates a method 60 for delivering a combination of vapor from different products. At step 62 an add-on tank is secured to a vaporizer, such as add-on tank 40 to vaporizer 10. The desired operating parameters are selected at step 64. This may be done through control panel 14. A first product is vaporized at step 66 and a second product is vaporized at step 68. For example, a first product may be vaporized in cartridge 24 and a second product may be vaporized in add on tank 40. The two vapors are then combined in step 70. The two vapors may be combined by channeling second vapor through port 46 and through vaporizer 10. The second vapor then enters cartridge 24 to mix with first vapor. The combined vapor is then exhausted in step 72. The combined vapor may be exhausted through outlet of vaporizer 10.

The descriptions set forth above are meant to be illustrative and not limiting. Various modifications of the invention, in addition to those described herein, will be apparent to those skilled in the art from the foregoing description. Such modifications are also intended to fall within the scope of the concepts described herein. The disclosures of each patent, patent application and publication cited or described in this document are hereby incorporated herein by reference, in their entireties.

The foregoing description of possible implementations consistent with the present disclosure does not represent a comprehensive list of all such implementations or all variations of the implementations described. The description of some implementation should not be construed as an intent to exclude other implementations. For example, artisans will understand how to implement the invention in many other ways, using equivalents and alternatives that do not depart from the scope of the invention. Moreover, unless indicated to the contrary in the preceding description, none of the components described in the implementations are essential to the invention. It is thus intended that the embodiments disclosed in the specification be considered as illustrative, with a true scope and spirit of the invention being indicated by the following claims.

We claim:

1. A vaporizer, comprising:

a first vaporizer element comprising:

a first body having an upper end and a lower end opposite the upper end, wherein the first body has a cavity in the upper end for receiving a cartridge, a first air inlet, and a first vapor outlet, a first cartridge disposed in the cavity, the first cartridge containing a first product and a first atomizer for atomizing the first product, and a battery housed within the first body and in operable communication with the first cartridge, the battery being positioned between the cavity and the lower end of the first body;

a second vaporizer element comprising a second body containing a heating element, a second air inlet, and a second vapor outlet, and a second product, the second vaporizer element being coupled to the lower end of the first body such that the battery is positioned between the first cartridge and the second vaporizer element;

a controller in electrical communication with the first cartridge and the second vaporizer element, the controller being configured to control an amount of vapor produced by the first cartridge and the second body;

a first fluid path passing from the second vapor outlet through the first air inlet to the first cartridge for combining vapor from the second vaporizer element with the vapor produced by the first cartridge; and a second fluid path passing from the first cartridge to the first vapor outlet.

2. The vaporizer according to claim 1, wherein the first cartridge is interchangeable with a second cartridge containing an alternate product and a second atomizer for atomizing the alternate product.

3. The vaporizer according to claim 1, wherein fluid and electrical connection between the first body and the second body are established when the lower end of the first body is inserted into the recess of the second body.

4. A method for delivering a combination of vapor from a first vaporizable product and a second vaporizable product, said method comprising:

providing a vaporizer according to claim 1;

securing the second vaporizer element to the first vaporizer element;

selecting operating parameters for the first atomizer and the heating element;

vaporizing the first product to form a first vapor;

vaporizing the second product to form a second vapor;

combining the first vapor with the second vapor to form a combined vapor; and removing the combined vapor from the vaporizer.

5. A vaporizer, comprising:

a first vaporizer element comprising:

a first body having an upper end and a lower end, wherein the first body has a cavity in the upper end for receiving a cartridge, a first air inlet, and a first vapor outlet, and a first cartridge disposed in the cavity, the first cartridge containing a first product and a first atomizer for atomizing the first product;

a second vaporizer element comprising a second body containing a heating element, an a second air inlet, and a second vapor outlet, and a second product, the second body having a recess complementary to a shape of the lower end of the first vaporizer element to thereby allow the lower end of the first vaporizer element to be inserted therein and coupled to the first vaporizer element;

a controller in electrical communication with the first cartridge and the second vaporizer element, the controller configured to control the amount of vapor produced by the first cartridge and the second body;

a first fluid path passing from the second vapor outlet through the first air inlet to the first cartridge for combining vapor from the second vaporizer element with the vapor produced by the first cartridge; and a second fluid path passing from the first cartridge to the first vapor outlet.

6. The vaporizer according to claim 5, wherein the second vapor outlet is configured to align with the first vapor outlet.

7. The vaporizer according to claim 5, wherein the first vaporizer element further comprises a power port for charging the battery.

8. The vaporizer according to claim 5, wherein the first product is a material comprising any one of a loose leaf material, a wax material, and a liquid.

9. The vaporizer according to claim 5, wherein the second product is a material comprising any one of a loose leaf material, a wax material, and a liquid.

10. The vaporizer according to claim 5, wherein the first body further comprises a third air inlet disposed on an exterior surface of the first body, the third air inlet in fluid communication with the first atomizer.

11. The vaporizer according to claim 5, wherein the controller is configured to identify the second body.

12. The vaporizer according to claim 5, wherein the first vaporizer element further comprises an inductive element for wirelessly charging the battery.

13. The vaporizer according to claim 5, wherein the second air inlet is annularly shaped.

14. The vaporizer according to claim 5, wherein the first product comprises a first material, and wherein the second product comprises the first material.

15. The vaporizer according to claim 5, wherein the first product comprises a first material, and the second product comprises a second material differing from the first material.

16. A method for delivering a combination of vapor from a first vaporizable product and a second vaporizable product, said method comprising:

providing a vaporizer according to claim 5;

selecting operating parameters for the first atomizer and a second atomizer;

vaporizing the first product to form a first vapor;

vaporizing the second product to form a second vapor;

combining the first vapor with the second vapor to form a combined vapor; and removing the combined vapor from the vaporizer.

17. A vaporizer, comprising:

a first body having an upper end and a lower end opposite the upper end, the upper end having a cavity for receiving a cartridge;

a first cartridge disposed in the cavity and configured to contain a first product, the first cartridge includes a first atomizer that is configured to vaporize the first product;

a first battery housed in the first body and in operable communication with the first cartridge; and a second body having a heating element and a second product, the second body coupled to the lower end of the first body such that the first battery is positioned between the first cartridge and the second body.

18. The vaporizer according to claim 17, wherein the first body further comprises a first air inlet disposed on the lower end and in fluid communication with the first atomizer, and wherein the second body further comprises a second air inlet disposed on an exterior surface of the second body and a port disposed in the recess, aligned with the first air inlet, and in fluid communication with the second air inlet, the port configured to permit transport of air from the second air inlet to the first atomizer.

19. The vaporizer according to claim 17, wherein the first product is a material comprising any one of a loose leaf material, a wax material, and a liquid.

20. The vaporizer according to claim 18, wherein the first body further comprises a third air inlet disposed on the exterior surface of the first body, the third air inlet in fluid communication with the first atomizer.

* * * * *